United States Patent [19]

Iwamori

[11] Patent Number: 4,610,604

[45] Date of Patent: Sep. 9, 1986

[54] SWASH-PLATE-TYPE COMPRESSOR WITH A MUFFLING ARRANGEMENT

[75] Inventor: Hidekazu Iwamori, Kariya, Japan

[73] Assignee: Kabushiki Kaisha Toyoda Jidoshokki Seisakusho, Aichi, Japan

[21] Appl. No.: 713,995

[22] Filed: Mar. 20, 1985

[30] Foreign Application Priority Data

Mar. 21, 1984 [JP] Japan ..... 59-41130[U]

[51] Int. Cl.[4] ..... F04B 1/16; F04B 1/18; F04B 39/00

[52] U.S. Cl. ..... 417/269; 417/312

[58] Field of Search ..... 417/269, 312; 181/200

[56] References Cited

U.S. PATENT DOCUMENTS 3,612,213 10/1971 Piko ..... 417/312
3,660,979 5/1972 Kamakura ..... 417/312
3,785,751 1/1974 Nemoto ..... 417/312
4,522,567 6/1985 Kato et al. ..... 417/270
4,534,710 8/1985 Higuchi et al. ..... 417/312

*Primary Examiner*—William L. Freeh
*Attorney, Agent, or Firm*—Burgess, Ryan & Wayne

[57] ABSTRACT

A multi-cylinder swash-plate-type compressor having a combined cylinder block closed on both axial ends by front and rear housing and provided therein with a reciprocative piston mechanism, for sucking, compressing, and discharging a refrigerant gas, and a connecting flange, from which the refrigerant gas after compression is sent out toward a cooling circuit. The connecting flange defines a muffling chamber in cooperation with a circumferential section of the combined cylinder block for suppressing the pulsation in discharge pressure of the refrigerant gas. The compressor further has a pair of mutually opposed gas outlets arranged adjacent to and downstream of the muffling chamber so that two streams of the refrigerant gas after compression collide, weakening the pulsation in the discharge pressure of the refrigerant gas.

8 Claims, 6 Drawing Figures

SWASH-PLATE-TYPE COMPRESSOR WITH A MUFFLING ARRANGEMENT

BACKGROUND OF THE INVENTION

1. Field of the Invention

The present invention relates to a swash-plate-type compressor, preferably adapted for use in automobile air-conditioning systems, more specifically to a swash-plate-type compressor with a muffling arrangement for suppressing pulsation in discharge pressure of a refrigerant gas after compression.

2. Description of the Prior Art

Generally, in a swash-plate-type refrigerant gas compressor for use in automobile air-conditioning systems, refrigerant gas returning from the air-conditioning system is sucked into and compressed by a multi-cylinder compressing system having pistons operated by a single rotary swash plate. The refrigerant gas, when compressed, is discharged from the cylinder bores into discharge chambers provided at axially front and rear sides of a cylinder block unit of the compressor. The compressed refrigerant gas is then passed through discharged passageways of the cylinder block unit and is further collected together. Subsequently, the collected refrigerant gas is sent out through a connecting flange toward a cooling circuit of the air-conditioning system.

During the above-mentioned compressing and discharging of the refrigerant gas, there is pulsation in the discharge pressure of the gas due to the reciprocating motion of the pistons. The frequency of the pulsation depends on the number of the cylinder bores. The pulsation needs to be suppressed to prevent noise and vibration problems. Accordingly, a muffling chamber has conventionally been provided in the refrigerant-gas delivery circuit for reducing the pulsation in the discharge pressure of the refrigerant gas.

FIG. 1 illustrates a conventional case where a chamber 51 having a substantial volume is provided as a muffling chamber. The chamber 51 is provided in a connecting flange 50*a* for sending out the refrigerant gas after compression toward a cooling circuit of the air-conditioning system. The refrigerant gas after compression is once choked by orifices 53 and then flows into the muffling chamber 51 so as to suddenly expand. The refrigerant gas is then again choked by an orifice 54 prior to flowing into the cooling circuit. Thus, the sudden expansion and the double choking of the refrigerant gas contributes to suppression of the pulsation.

FIG. 2 illustrated another conventional case where a casing 50*b* is arranged in a delivery circuit 52. The casing 50*b* provides a muffling chamber 51 and two inlet and outlet orifices 53 and 54 for the refrigerant gas delivered from the compressor. Pulsation is similarly suppressed while the refrigerant gas, after compression, passes through the muffling chamber 51 and the orifices 53 and 54.

However, in the conventional arrangements of muffling chambers as shown in FIGS. 1 and 2, the suppressing efficiency of the pulsation as well as the suppressing frequency are determined by the ratio of the cross-sectional areas of the orifices and the muffling chamber and the length of the muffling chamber in the flowing direction of the refrigerant gas. Therefore, an extremely large volume muffling chamber is needed to obtain the necessary suppressing efficiency and suppressing frequency.

In order to eliminate the above problem, U.S. Pat. No. 3,785,751 to Nemoto et al discloses a silencing chamber formed on the cylindrical casing of a swash-plate-type compressor by means of a cover. In the compressor, the silencing action is obtained by a sudden change of volume of the compressed gas when the compressed gas enters into the silencing chamber. However, there is no teaching of any additional action to suppress the pulsation in discharging pressure of the refrigerant gas.

BRIEF SUMMARY OF THE INVENTION

An object of the present invention is to improve the suppression of the pulsation in the discharge pressure of refrigerant gas compressed by a swash-plate-type compressor.

Another object of the present invention is to provide a multi-cylinder swash-plate-type compressor which has a muffling arrangement capable of fully suppressing the discharge pressure pulsation in spite of provision of a rather small muffling chamber.

A further object of the present invention is to provide a multi-cylinder swash-plate-type compressor of quiet operation.

In accordance with the present invention, there is provided a multi-cylinder swash-plate-type compressor adapted for use in compressing a refrigerant gas of a cooling circuit, including: cylinder block means having therein a swash-plate-operated reciprocative piston mechanism for sucking, compressing, and discharging a refrigerant gas and delivery passage means for delivering the refrigerant gas after compression; housing means arranged so as to close axial ends of the cylinder block means and having therein suction and discharge chambers communicatable with the reciprocative piston mechanism; and connecting flange means mounted on the cylinder block means for sending out the refrigerant gas after compression from the discharge chambers to the cooling circuit via the delivery passage means of the cylinder block means. The compressor is characterized by including muffling chamber means closed by the connecting flange means, for receiving a substantial amount of the refrigerant gas after compression delivered from the delivery passage means, and means for causing a pair of opposed streams of the refrigerant gas after compression to collide before the refrigerant gas after compression is received by the muffling chamber means.

Preferably, the cylinder block means has a pair of axially aligned cylinder blocks, one being axially longer than the other and being formed with wall means extended vertically to an aligned axis of the pair of cylinder blocks. In addition, the connecting flange means is attached to the wall means of the longer cylinder block in a sealing manner for defining the muffling chamber means within the wall means.

BRIEF DESCRIPTION OF THE DRAWINGS

The present invention will be more apparent from the ensuing description of embodiments with reference to the accompanying drawings, wherein.

DESCRIPTION OF THE PREFERRED EMBODIMENT

Figure 3:
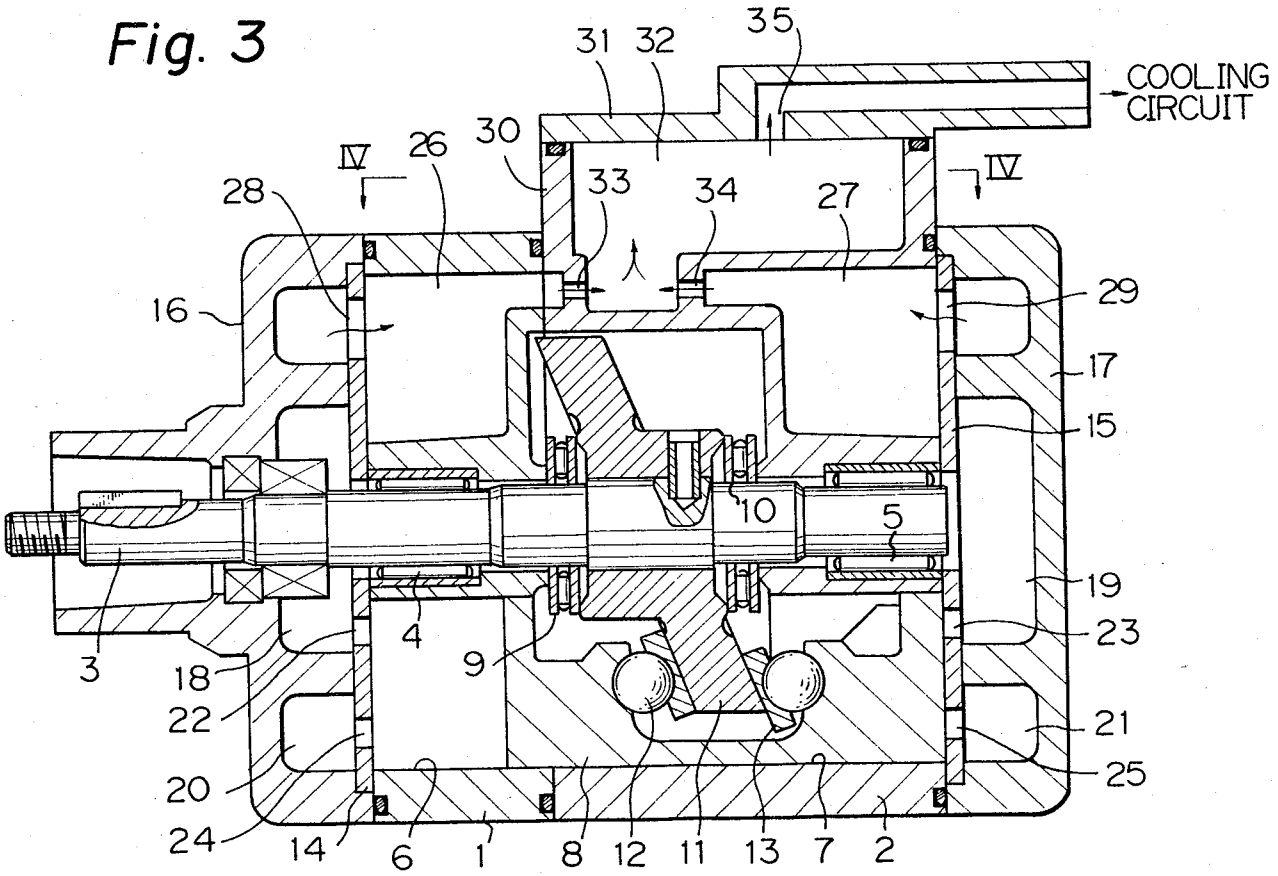
FIG. 3 is a longitudinal cross-sectional view of a multi-cylinder swash-plate-type compressor according to an embodiment of the present invention.
Figure 4:
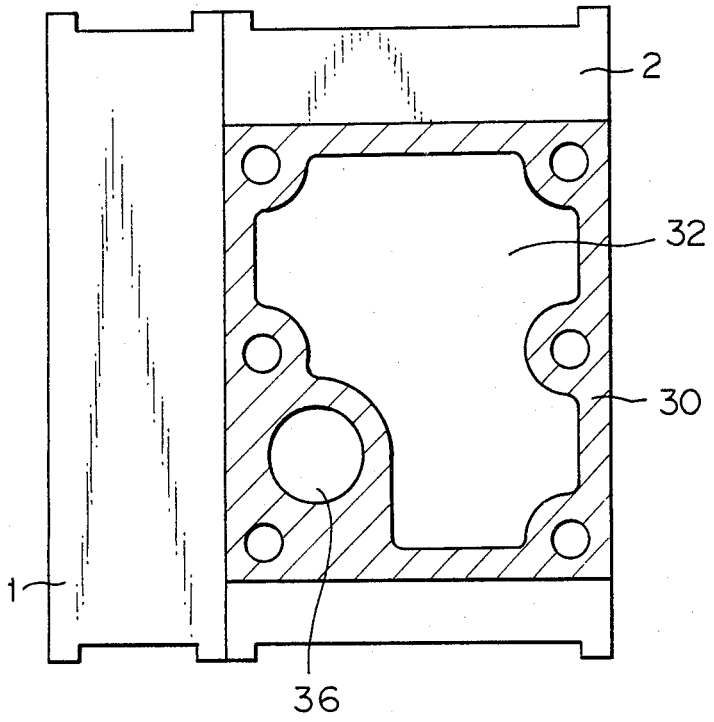
FIG. 4 is a cross-sectional view taken along the line IV—IV of FIG. 3.

Referring to FIGS. 3 and 4, the multi-cylinder swash-plate-type compressor has a front cylinder block 1 and a rear cylinder block 2 combined with one another in axial alignment. The plane of junction of the two cylinder blocks 1 and 2 is displaced away from the center of the combined cylinder blocks 1 and 2 toward the front cylinder block 1. The compressor also has a drive shaft 3 centrally and rotatably supported by the combined cylinder blocks 1 and 2 via radial bearings 4 and 5. The combined cylinder blocks 1 and 2 are provided with an appropriate number of axially extending cylinder bores 6 and 7 arranged in parallel with one another and with the above-mentioned drive shaft 3. Within the cylinder bores 6 and 7 are disposed a number of doubleheaded pistons 8 operated by a swash plate 11 via ball bearings 12 and shoes 13. The swash plate 11 per se is slantedly fixed to the drive shaft 3 and is supported by thrust bearings 9 and 10.

Figure 1:
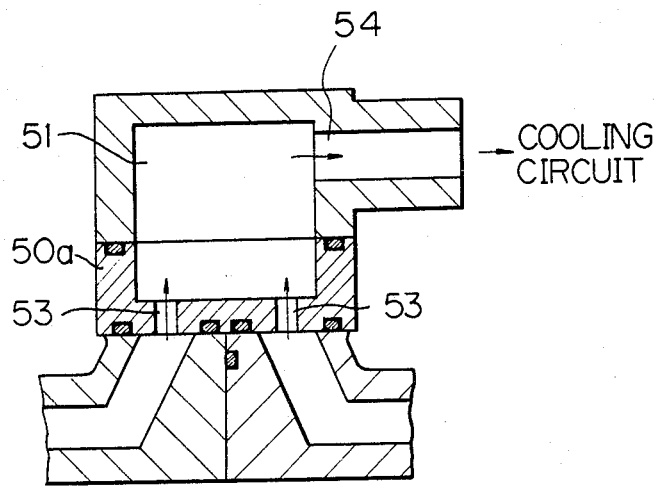
Fig. 1 PRIOR ART
FIGS. 1 and 2 are cross-sectional views of a conventional muffling arrangement for suppressing the pulsation in discharge pressure of refrigerant gas compressed by and delivered from a swash-plate-type compressor.
Figure 2:
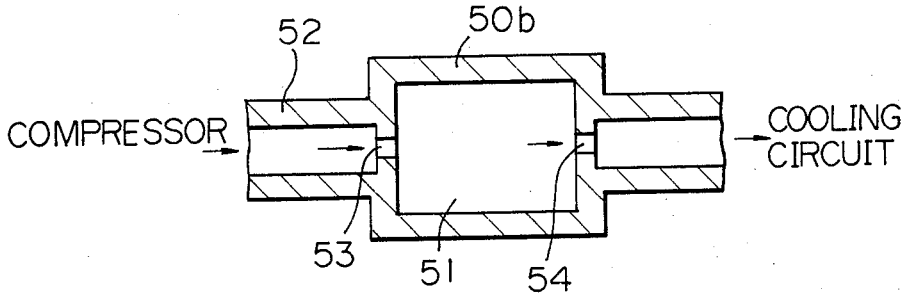
Fig. 2 PRIOR ART

Front and rear ends of the combined cylinder blocks are fluid-tightly closed by front and rear housings 16 and 17, respectively, via front and rear valve plates 14 and 15. The housings 16 and 17 are formed with inner suction chambers 18 and 19 and outer discharge chambers 20 and 21, respectively. The suction chambers 18 and 19 of the front and rear housings 16 and 17 are respectively communicated with the cylinder bores 6 and 7 by way of suction ports 22 and 23 bored in the front and rear valve plates 14 and 15. The discharge chambers 20 and 21 of the front and rear housings 16 and 17 are respectively communicated with the cylinder bores 6 and 7 by way of discharge ports 24 and 25 bored in the front and rear valve plates 14 and 15. The suction ports 22 and 23 and the discharge ports 24 and 25 are operated by reed valves (not illustrated in FIG. 1). The combined cylinder blocks 1 and 2 have formed therein discharge passageways 26 and 27 communicated with the discharge chambers 20 and 21 of the front and rear housings 16 and 17 by way of communicating bores 28 29 formed in the front and rear valve plates 14 and 15. It is to be noted that the discharge passageways 26 and 27 are arranged between two adjacent cylinder bores 6 and cylinder bores 7 around the axis of the combined cylinder blocks 1 and 2.

Wall 30 is projected outward from the outer circumference of one of the combined cylinder blocks 1 and 2, i.e., the rear cylinder block 2 in the case of the present embodiment, so as to enclose a chamber having a substantial volume. The wall 30 is formed integrally with the rear cylinder block 2 and is located adjacent to the discharge passageway 27. On the top of the wall 30 is mounted in a sealing manner a connecting flange 31 which closes the chamber of the wall 30 to define a closed muffling chamber 32. The muffling chamber 32 is communicated with the front and rear discharge passageways 26 and 27 by means of a pair of orifices 33 and 34 so as to receive the refrigerant gas after compression discharged from the discharge passageways 26 and 27. The pair of orifices 33 and 34 operate so as to choke the streams of the refrigerant gas passing therethrough before entering into the muffling chamber 32. In addition, since the pair of orifices 33 and 34 are arranged so as to oppose one another, streams of the refrigerant gas having passed through the two orifices 33 and 34 striking or colliding with one another within the muffling chamber 32. The refrigerant gas in the muffling chamber 32 flows out of the chamber 32 through an outlet orifice 35 formed in the connecting flange 31 and further flows toward the cooling circuit of the air-conditioning system. A port 36 formed in the wall 30 is a suction port for sucking the refrigerant gas returning from the cooling circuit of the air-conditioning system.

With the above-described structure of the swash-plate-type compressor, the operations of the compressor, i.e., sucking, compressing, and discharging of the refrigerant gas, are conducted by the rotation of the drive shaft 3. The drive shaft 3 is rotated from the outside, for example, by an automobile engine. The rotation of the drive shaft 3 together with the swash plate 11 causes reciprocative motion of the pistons 8 in the cylinder bores 6 and 7. Thus, the refrigerant gas returning from the cooling circuit is eventually sucked into the cylinder bores 6 and 7 by way of the suction port 36, the front and rear suction chambers 18 and 19, and the front and rear suction ports 22 and 23. The refrigerant gas is then subjected to compressing action by the pistons 8.

The refrigerant gas after compression is discharged from the cylinder bores 6 and 7 to the discharge chambers 20 and 21 through the discharge ports 24 and 25 of the front and rear valve plates 14 and 15. The refrigerant gas in both discharge chambers 20 and 21 then goes through the delivery passageways 26 and 27 and through the pair of mutually opposed orifices 33 and 34 to the muffling chamber 32, in which streams of the refrigerant gas having passed through the orifices 33 and 34 collide and are gathered together. Within the muffling chamber 32, the refrigerant gas is subjected to expansion. Subsequently, the refrigerant gas is sent out of the chamber 32 through the outlet orifice 35, by which the refrigerant gas is again choked before flowing toward the cooling circuit. That is to say, the refrigerant gas after compression is subjected to not only choking and expansion but also collision, by which the pressure pulsation of the refrigerant gas is appreciably reduced or weakened in magnitude. Thus, the pulsation in discharge pressure of the refrigerant gas can be sufficiently suppressed when the refrigerant gas leaves the connecting flange 31 and flows toward the cooling circuit.

In the present embodiment of FIGS. 3 and 4, since the plane of junction of the cylinder blocks 1 and 2 is moved away from the center of the combined cylinder blocks and since the muffling chamber 32 is formed on the outer circumference of the longer cylinder block 2, the volume of the muffling chamber 32 can be larger than the case where the plane of junction of the two cylinder blocks is located at the center of the combined cylinder blocks. As a result, the suppression of the pulsation in discharge pressure of the refrigerant gas can be more enhanced.

Figure 5:
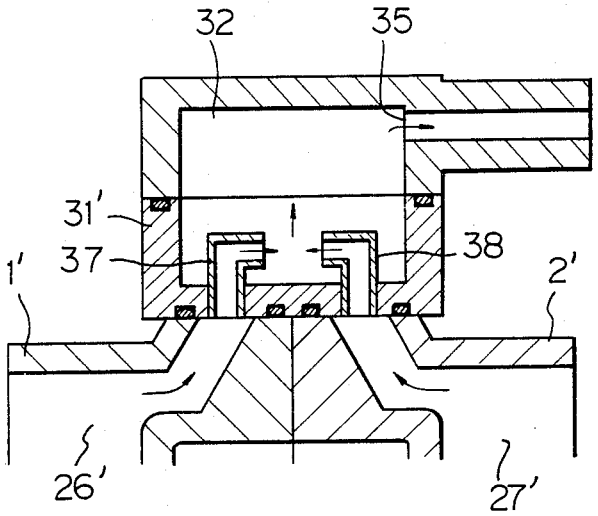
FIG. 5 is a partial cross-sectional view of a muffling arrangement, illustrating another embodiment of the present invention.

FIG. 5 illustrates another embodiment in which the plane of junction of two cylinder blocks 1′ and 2′ is located at the center of the combined cylinder blocks. A connecting flange 31′ is mounted on the combined cylinder blocks 1′ and 2′ at the position of junction of the two cylinder blocks 1′ and 2′. The connecting flange 31′ is formed therein with a muffling chamber 32 into which two pipes 37 and 38 are projected so as to provide fluid communication between the delivery passageways 26' and 27' of the two cylinder blocks 1' and 2' and the muffling chamber 32'. The pipes 37 and 38 are provided with a pair of mutually opposed inlet orifices from which a pair of streams of the refrigerant gas are discharged into the muffling chamber 32 for collision of the streams. The refrigerant gas is sent out of the chamber 32 through an outlet orifice 35 toward the cooling circuit. Thus, in the embodiment of FIG. 5, the refrigerant gas can be subjected to a pulsation suppressing action due to collision in addition to choking, expansion, and re-choking. The pipes 37 and 38 in the L shape are firmly fit in the connecting flange 31'.

Figure 6:
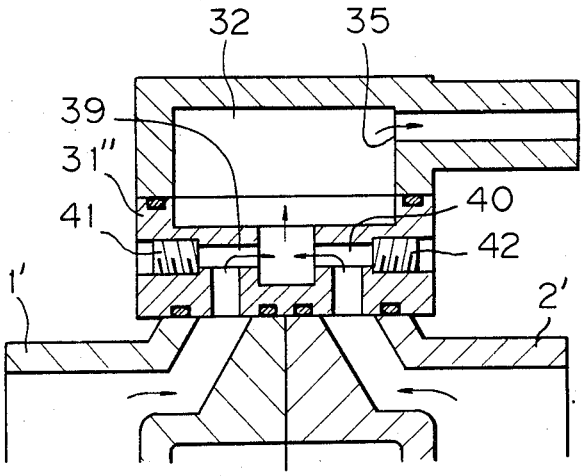
FIG. 6 is a partial cross-sectional view of a muffling arrangement, illustrating a further embodiment of the present invention.

FIG. 6 illustrates a further embodiment in which a connecting flange 31" having a muffling chamber 32 is formed with machined orifices 39 and 40 plugged at their outer ends by screws 41 and 42. The orifices 39 and 40 form a pair of mutually opposed inlet holes through which a pair of streams of the refrigerant gas enter into the muffling chamber 32. Thus, the orifice 39 and 40 are able to cause collision of the two streams of the refrigerant gas after compression with the muffling chamber 32. Accordingly, it is possible to expect sufficient suppression of the pressure pulsation in the compressed refrigerant gas as in the case of the previous embodiments of FIGS. 3 and 4 and FIG. 5.

At this stage, it is to be noted that, in the case of the two embodiments of FIGS. 5 and 6, the connecting flange 31' or 31" is provided therein with orifices 37, 38 or 39, 40. Therefore, the connecting flange 31' or 31" is easily applied to the existing swash-plate-type compressor without requiring any change to the compressor per se.

From the foregoing description, it will be understood that according to the present invention, there is provided a multi-cylinder swash-plate-type compressor with a muffling arrangement in which the refrigerant gas after compression is subjected to collision action for weakening the pulsation in pressure of the refrigerant gas in addition to choking and expansion actions. Therefore, the pulsation in discharge pressure of the refrigerant gas after compression can be strongly suppressed so as to fully reduce noise and vibration. This fact means that in order to obtain suppression of the pressure pulsation in the discharged refrigerant gas, the muffling chamber can be smaller than the conventional case. Further, the suppression efficiency of the pressure pulsation and the suppression frequency can be adjusted by changing the distance between the mutually opposed orifices.

I claim:

1. In a multi-cylinder swash-plate-type compressor adapted for use in compressing a refrigerant gas of a cooling circuit, including:

cylinder block means having therein a swash-plate operated reciprocative piston mechanism for sucking, compressing, and discharging a refrigerant gas and delivery passage means for delivering the refrigerant gas after compression, housing means arranged so as to close axial ends of the cylinder block means and having therein suction and discharge chambers in communication with the reciprocative piston mechanism, and connecting flange means mounted on the cylinder block means for sending out the compressed refrigerant gas from the discharge chambers to the cooling circuit via the delivery passage means of the cylinder block means, the improvement which comprises:

muffling chamber means closed by said connecting flange means for receiving said compressed refrigerant gas delivered from a collision zone means, and said collision zone means in gas flow communication with said muffling chamber means, for causing a pair of opposed streams of said compressed refrigerant gas to collide before said compressed refrigerant gas enters said muffling chamber means, said collision zone means in flow communication with said delivery passage means.

2. A multi-cylinder swash-plate-type compressor according to claim 1, wherein said cylinder block means comprises a pair of axially aligned cylinder blocks, one having an axial length longer than that of the other and being formed with wall means extending perpendicularly to an aligned axis of said pair of cylinder blocks, and wherein said connecting flange means is attached to said wall means of said one cylinder block having a longer axial length in a sealing manner for defining said muffling chamber means within said wall means.

3. A multi-cylinder swash-plate-type compressor according to claim 2, wherein said means for causing a pair of opposed streams of said compressed refrigerant gas to collide comprises a pair of mutually opposed narrow holes formed in said wall means in the collision zone, said narrow holes being in communication with said delivery passage means of said cylinder block means.

4. A multi-cylinder swash-plate-type compressor according to claim 1, wherein said muffling chamber means is defined by said connecting flange means.

5. A multi-cylinder swash-plate-type compressor according to claim 4, wherein said means for striking a pair of opposed streams of said refrigerant gas after compression comprises a pair of pipes mounted in said connecting flange means, said pair of pipes having a pair of gas inlets communicating with said delivery passage means of said cylinder block means and a pair of gas outlets opposed to one another in said muffling chamber means defined in said connecting flange means.

6. A multi-cylinder swash-plate-type compressor according to claim 4, wherein said means for causing collision of the pair of opposed streams of said compressed refrigerant gas comprises a pair of symmetrically arranged holes machined in said connecting flange means, said pair of symmetrically arranged holes having a pair of mutually opposed gas outlets in said collision zone, said delivery passage means of said cylinder block means is in communication with said symmetrically arranged holes.

7. A multi-cylinder swash-plate-type compressor according to claim 1, wherein said connecting flange means comprises a narrow delivery port arranged at a position of said muffling chamber means distant from said means of communication with the collision zone, said narrow delivery port being in fluid communication with said cooling circuit.

8. A multi-cylinder compressor adapted for use in compressing a refrigerant gas of an air-conditioning system of a vehicle comprising:

cylinder block means having therein a swash-plate-operated reciprocative piston mechanism for sucking, compressing, and discharging a refrigerant gas and delivery passage means for delivering the compressed refrigerant gas;

a drive shaft rotatably arranged in said cylinder block means and mounting thereon a swash plate for driving said reciprocative piston mechanism;

housing means having therein a discharge chamber means into which the refrigerant gas is discharged from said reciprocative piston mechanism and a suction chamber means from which the refrigerant gas is sucked into said reciprocative piston mechanism;

valve plates arranged between opposed ends of said cylinder block means and said housing means for defining therein inlet ports to connect said suction chamber means to said reciprocative piston mechanism and outlet port means to connect said discharge chamber to said delivery passage means;

connecting flange means mounted on said cylinder block means for sending out the compressed refrigerant gas from said delivery passage means of said cylinder block means toward said air-conditioning system;

collision zone means for promoting collision of a pair of opposed streams of the compressed refrigerant gas delivered from said delivery passage means of said cylinder block means, thereby weakening the pulsation in discharge pressure of said compressed refrigerant gas; and muffling chamber means in flow communication with the collision zone means for receiving said compressed refrigerant gas prior to sending out said gas toward said aid-conditioning system, thereby suppressing the pulsation in discharge pressure of said gas weakened by said means for promoting collision of a pair of opposed streams of the refrigerant gas after compression.

* * * * *